US006342138B1

(12) United States Patent
Brown

(10) Patent No.: US 6,342,138 B1
(45) Date of Patent: Jan. 29, 2002

(54) CLAMP FOR ELECTROPLATING ARTICLES

(75) Inventor: Howard Brown, Pointe-Claire (CA)

(73) Assignee: M & B Plating Racks Inc., Montreal (CA)

( * ) Notice: Subject to any disclaimer, the term of this patent is extended or adjusted under 35 U.S.C. 154(b) by 0 days.

(21) Appl. No.: 09/654,035

(22) Filed: Sep. 1, 2000

(51) Int. Cl.[7] ..... C25B 9/02

(52) U.S. Cl. ..... 204/297.09; 204/297.01; 204/297.06; 204/297.1; 204/297.14; 204/297.15; 248/226.11; 248/227.3; 248/229.16; 248/316.1; 248/689; 267/158; 267/159; 267/160; 267/163; 269/47; 269/49; 269/50; 269/59; 269/60; 269/74; 269/76; 269/95; 269/97; 269/101; 269/152; 269/153; 211/120

(58) Field of Search ..... 204/297.01, 297.06, 204/297.09, 297.1, 297.14, 297.15; 248/226.11, 227.3, 229.16, 316.1, 689; 267/158, 159, 160, 163; 269/47, 49, 50, 59, 60, 74, 76, 95, 97, 101, 152, 153

(56) References Cited

U.S. PATENT DOCUMENTS

| | | | | |
|---|---|---|---|---|
| 1,282,259 | A | | 10/1918 | Merritt |
| 1,484,194 | A | | 2/1924 | Servis |
| 2,190,440 | A | | 2/1940 | Beebe |
| 2,367,909 | A | | 1/1945 | Wanner |
| 4,088,559 | A | | 5/1978 | Sandmeier et al. |
| 4,176,039 | A | | 11/1979 | Wismer |
| 4,664,771 | A | * | 5/1987 | Docktor et al. ..... 204/297.1 |
| 5,380,418 | A | * | 1/1995 | Strecker ..... 204/297.14 |
| 5,669,590 | A | * | 9/1997 | Przewodek ..... 248/74.2 |
| 5,759,363 | A | * | 6/1998 | Rose ..... 204/297.15 |
| 5,904,820 | A | * | 5/1999 | Brown et al. ..... 204/297.14 |
| 6,193,863 | B1 | * | 2/2001 | Kobayashi ..... 204/297.14 |
| 6,257,530 | B1 | * | 7/2001 | Tsai ..... 248/74.2 |

FOREIGN PATENT DOCUMENTS

| | | |
|---|---|---|
| CA | 1215939 | 12/1986 |

* cited by examiner

*Primary Examiner*—Bruce F. Bell
(74) *Attorney, Agent, or Firm*—Francois Martineau

(57) ABSTRACT

An electroplating rack includes a cathode flight bar from which depends an insulated rack bar over an acid bath. A clamp is fixed to the rack bar, and has a bridge electrically connected to the flight bar through a conducting core inside the insulated rack bar. The clamp has a main body made of plastic, which includes a slot in which protrudes the bridge. An electrically conducting spring clip is installed in the slot, and is formed of two arms continuously biased into a spreaded, opened condition in the slot. A screw carried by the main body, when rotated in a first direction, can force the spring clip into a closed condition, in which it can hold an article to be electroplated between its two arms, and in which one of the spring clip arms is forced against the bridge member. Thus, electrical current can pass through the rack flight bar and conducting core, then through the bridge member, the spring clip and finally into the article to be electroplated. Once the rack is lowered to submerge the article into the acid bath, the latter will be electroplated with this current passing through the article.

17 Claims, 5 Drawing Sheets

CLAMP FOR ELECTROPLATING ARTICLES

FIELD OF THE INVENTION

The present invention relates to article holders or clamps for electroplating articles.

BACKGROUND OF THE INVENTION

It is known in the art of electroplating to use frames on which are removably installed circuit boards or the like articles to be electroplated, for holding them while they are being submerged in large acid tanks or baths. The acid bath is one of several steps involved in the manufacture of a printed circuit board. The acid solution is usually either chloridric acid or sulfuric acid. The overhanging flames are made of an electrically conducting material sealed in a fluid-tight and electrically insulating material to substantially slow down the corrosive effects of the acidous vapors from the bath of acid, and are sealingly electrically connected to the articles to be plated. The frames are connected to a cathode element, or flight bar, and are subjected to an electrical current which is transmitted through the frame structure, the article and the liquid acid. An anode element is also submerged in the acid bath, spaced from the circuit board, for example of a distance of 6 to 10 inches. The potential difference between the article and the reducing agent anode element allows the metal composing the latter to migrate and attach itself onto the article. The metal composing the anode element can be for example copper, or any other suitable material combining a proper oxydo-reduction potential and suitable conductive characteristics.

An electroplating rack is shown in U.S. Pat. No. 4,176,039 issued in 1979 to J. C. Wismer. This electroplating rack includes clamps adapted to each hold one circuit board while it is submerged in an acid bath. The clamp holds the flat board on both sides, by means of a screw on a first side and a stopper on the other side. Both the screw and the stopper have electrically conducting cores destined to engage the board and connected to the flight bar, the cores being enveloped in sealing sleeves to help prevent corrosion thereof.

A first problem with the Wismer device is that the screw is likely to damage the board when it is rotated and pressed against the board. This is especially true when ultra-thin boards are to be installed on the clamp. Ultra-thin boards can be as thin as 0.002 inch. The damage to these board results mainly from the rotational movement and associated shearing effect of the screw, not from the transverse pressure applied on the board. In the case of the Wismer device, the resilient end seal provided at the screw tip around the electrically conducting core, is likely to enhance this problem due to the higher friction coefficient between the resilient seal material and the board. However, this seal is essential, or else the acid solution would have free access to the conducting core, the latter then being corroded at a high rate.

Another general problem with the Wismer device, is related to the maintenance of the electroplating rack. Although an end seal is provided at the screw tip, corrosion of the conducting core will still gradually occur at the screw tip. To remove the plating formed at the screw tip and resulting from this corrosion, the rack has to be submerged in a nitric acid bath or the like suitable solution which will allow the plating to be removed, which is a tedious and time-consuming operation. Alternately, the corroded parts, i.e. the screw tip and the stopper tip in the present case, have to be replaced, which is again time consuming, in addition to being expensive.

OBJECTS OF THE INVENTION

It is an object of the present invention to provide a clamp for holding articles to be electroplated, which has a replaceable connecting element which connects the article to the cathode flight bar.

It is a further object of the present invention to provide a connecting element which prevents friction movements of the clamp to occur against the article surface.

It is yet another object of the present invention that the connecting element allow the electric current to be transmitted on both sides of the article.

SUMMARY OF THE INVENTION

Therefore, in accordance with the objects of the invention, there is disclosed a spring clip for use as a connection member on an electroplating clamp, said spring clip being integrally formed of a folded, generally flat electrically conducting material and comprising a first and a second arm member and an arcuate foot member integrally linking said first and second arm members, said foot member having: a resilient elbow portion, allowing relative pivotal displacement of said first and second arm members between an opened condition, in which said first and second arm members spacedly register with one another and define a gap therebetween, and a closed condition, in which said first and second arm members are pivoted towards each other to at least reduce said gap therebetween, with said resilient elbow portion continuously biasing said first and second arm members towards said opened condition;—a first resilient lip, integrally formed between said elbow and said first arm member, said first lip protruding outwardly relative to said gap; and—a second resilient lip, integrally formed between said elbow and said second arm member, said second lip protruding inwardly toward said gap and toward said first lip.

Alternately, the invention more generally concerns a clamp for use on an electroplating rack of the type having an electrically conducting flight bar, said clamp comprising:—a main body made of an electrically insulating material;—an attachment member, for fixed attachment of said main body to the rack;—a conducting bridge member carried by said main body for electrical connection with the flight bar of said rack;—a spring clip carried by said main body and able to come into electrical contact with said bridge member, said spring clip being made of an electrically conducting material and being provided with first and second arms and an arcuate pivotable foot member linking said first and second arms, said pivotable foot member allowing relative pivotal displacement of said first and second arms between an opened condition in which said first and second arms spacedly register with one another so as to define a gap therebetween, and a closed condition, in which said first and second arms are pivoted towards each other to at least reduce said gap therebetween and in which said spring clip is in electrical contact with said bridge member;—a selectively operable pressure member carried by said main body and engageable with said spring clip so as to selectively pivot said first and second arms relative to each other from said opened condition towards said closed condition; and—a biasing member continuously biasing said first and second arm members toward said opened condition.

Preferably, said foot member of said spring clip is resilient and integrally links said first and second arms, said biasing member being said resilient foot member and continuously biasing said first and second arms towards said opened condition. Said spring clip could then be integrally formed of a folded, generally flat electrically conducting sheet, and wherein said foot member integrally linking said first and second arms comprises:—a resilient elbow portion allowing relative pivotal displacement of said first and second arms between said opened condition and said closed condition, with said resilient elbow portion continuously biasing said first and second arms towards said opened condition;—a first resilient lip, integrally formed between said elbow and said first arm, said first lip protruding outwardly relative to said gap; and—a second resilient lip, integrally formed between said elbow and said second arm, said second lip protruding inwardly toward said gap and toward said first lip.

Preferably, said pressure member is a screw threadingly engaging said clamp main body through a through-bore provided therein, said screw being able to gradually apply pressure on said spring clip second arm when said screw is rotated in a first direction to pivot said second arm towards said first arm and consequently pivot said first and second arms towards said closed condition, and said screw being able to gradually relieve the pressure on said spring clip second arm when said screw is rotated in a second direction opposite said first direction to allow said resilient foot member to bias said second arm away from said first arm and consequently pivot said first and second arms towards said opened condition. Said bridge member could then define a tip portion engageable with said spring clip at least when said first and second arms are in said closed condition, said clamp further comprising an insulating sleeve provided about said bridge member tip portion for sealing engagement against said spring clip about said bridge member tip portion at least when said first and second arms are in said closed condition. It is envisioned that said main body is generally U-shaped and defines a slot and a first lateral body portion for attachment to the rack, a second lateral body portion opposite said first body portion relative to said slot, and a web portion integrally linking said first and second lateral body portions, said spring clip being installed in said slot and being retained therein under said first and second arms being forced respectively against said first and second lateral body portions under the bias of said foot member, and said screw threadingly engaging a threaded through-bore made through said second lateral body portion, said screw having a tip portion engageable against said spring clip second arm. Said main body could also comprise a shoulder integrally formed in said slot, said spring clip first lip being capable of abutting against said shoulder to prevent accidental release of said spring clip from said slot. Preferably, said main body comprises a first block member and a second block member for attachment to on two opposide sides of the rack with said attachment member.

Alternately, the invention could also relate in still more general terms with an electroplating rack for electroplating an article in an acid bath, said rack comprising a cathode flight bar and a rack bar downwardly depending from said flight bar, said rack bar including an electrically conducting core electrically connected to said cathode flight bar and a fluid-tight, electrically insulating sheath enveloping said conducting core, said electroplating rack further comprising a clamp fixedly attached to said rack bar, said clamp comprising:—a main body made of an electrically insulating material;—an attachment member fixedly attaching said main body to said rack bar;—a conducting bridge member defining a core connection portion and a free tip portion, said bridge member being carried by said main body and being electrically connected with said rack bar conducting core at said core connection portion;—an electrically insulating and fluid-tight sleeve provided about said conducting bridge member and enveloping same except at said core connection portion and at said free tip portion, said sleeve comprising a seal portion near said bridge member free tip portion;—a spring clip carried by said main body and able to come into electrical contact with said bridge member free tip portion, said spring clip being made of an electrically conducting material and being provided with first and second arms and a pivotable foot member integrally linking said first and second arms, said pivotable foot member allowing relative pivotal displacement of said first and second arms between an opened condition in which said first and second arms are in spaced-apart register so as to define a gap therebetween, and a closed condition in which said first and second arms are pivoted towards each other to at least reduce said gap therebetween and in which said spring clip first arm is in electrical contact with said bridge member free tip portion, said seal portion of said sleeve engaging said spring clip about said bridge member free tip portion at least when said spring clip is in said closed condition so as to form a fluid-tight seal for said bride member free tip portion;—a biasing member continuously biasing said spring clip first and second arms towards said opened condition; and—a selectively operable pressure member carried by said main body and engageable with said spring clip so as to selectively pivot said first and second arms relative to each other from said opened condition towards said closed condition against the bias of said biasing member; wherein an article to be electroplated can be inserted into said gap between said first and second arms when said first and second arms are in said opened condition, said pressure member then being selectively operated to force said first and second arms into said closed condition for holding the article between said first and second arms, an electrical connection then existing sequentially through said flight bar, said conducting core, said bridge member, said spring clip and finally the article to be electroplated.

In this latter inventive concept, said foot member of said spring clip is preferably resilient and integrally links said first and second arms, said biasing member being said resilient foot member. Said spring clip could be integrally formed of a folded, generally flat electrically conducting sheet, and wherein said foot member integrally linking said first and second arms comprises:—a resilient elbow portion allowing relative pivotal displacement of said first and second arms between said opened condition and said closed condition, with said resilient elbow portion continuously biasing said first and second arms towards said opened condition;—a first resilient lip formed between said elbow and said first arm, said first lip protruding outwardly relative to said gap;—a second resilient lip formed between said elbow and said second arm, said second lip protruding inwardly toward said gap and toward said first lip.

Preferably, said pressure member is a screw threadingly engaging said clamp main body through a through-bore provided therein, said screw being able to gradually apply pressure on said spring clip second arm when it is rotated in a first direction to pivot said second arm towards said first arm and consequently pivot said first and second arms towards said closed condition, and said screw being able to gradually relieve the pressure on said spring clip second arm when it is rotated in a second direction opposite said first direction to allow said resilient foot member to bias said second arm away from said first arm and consequently pivot said first and second arms towards said opened condition.

Said main body could be generally U-shaped and define a slot and a first lateral body portion fixedly attached to said rack bar, a second lateral body portion opposite said first body portion relative to said slot, and a web portion integrally linking said first and second lateral body portions, said spring clip being installed in said slot and being retained therein under said first and second arms being forced respectively against said first and second lateral body portions under the bias of said foot member, and said through bore being made through said second lateral body portion. Said main body could also comprise a shoulder integrally formed in said slot, said spring clip first lip being capable of abutting against said shoulder to prevent accidental release of said spring clip from said slot. Said main body could also comprise a first block member and a second block member each engaging said rack bar on opposite sides thereof, and being attached to each other with said attachment member.

In an alternate embodiment of this latter inventive concept, there is provided an additional slot formed in said main body, with an additional spring clip being provided therein, and with an additional screw being engageable with said additional spring clip for releasably holding an additional article when said additional spring clip is in a closed condition, said clamp further comprising an additional bridge member electrically connected to said additional spring clip when said additional spring clip is in said closed condition, said rack comprising an additional rack bar having an additional conducting core enveloped in an additional insulating sheath, with said additional bridge member being electrically connected to said additional conducting core, said additional clamp being fixedly attached also to said additional rack bar with said attachment member, whereby the additional article can be carried by said clamp simultaneously with the first-named article.

DETAILED DESCRIPTION OF THE EMBODIMENTS

Figure 1:
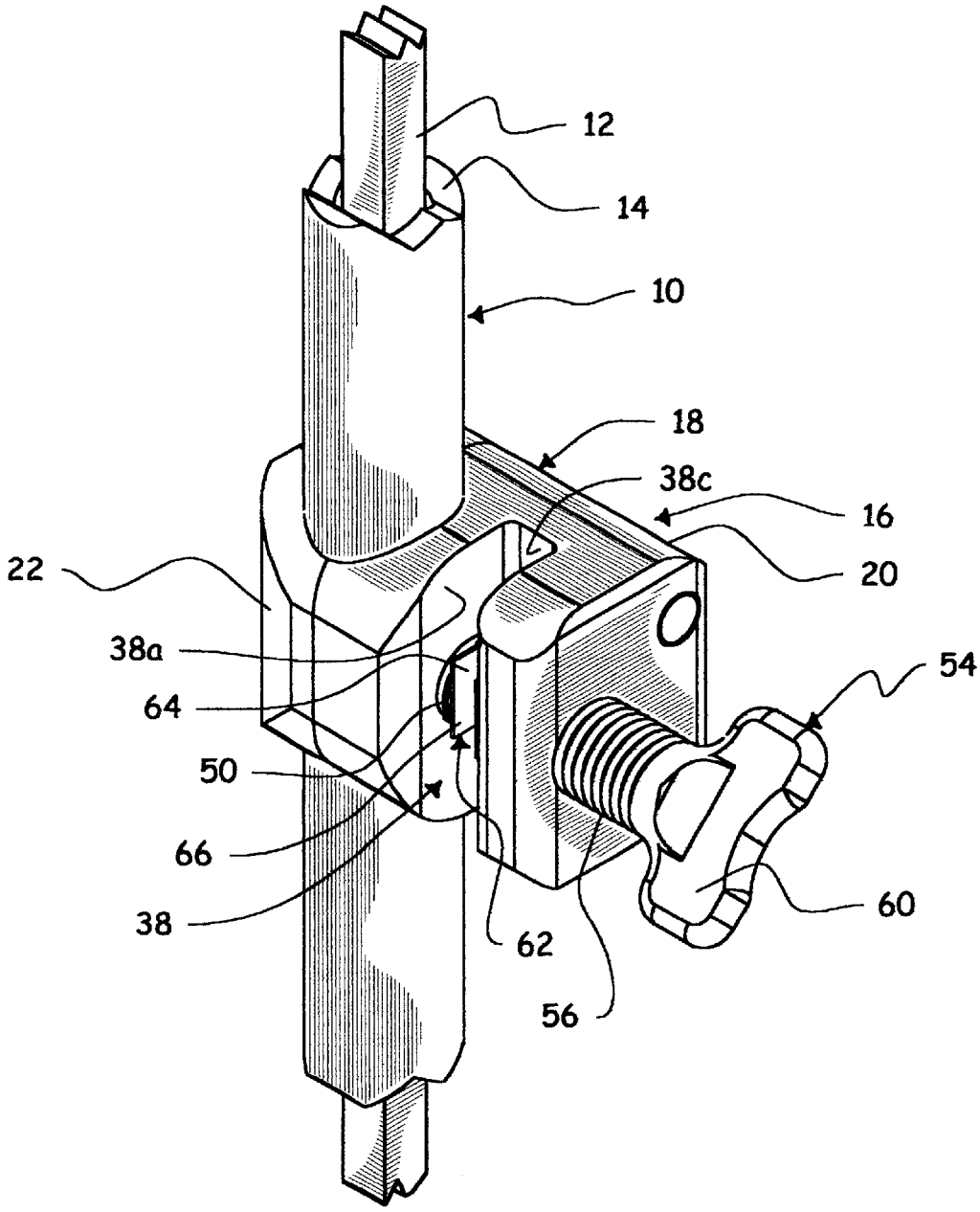
FIGS. 1 and 2 are respectively a perspective view and an exploded perspective view of a first embodiment of the clamp according to the present invention, and further showing a portion of an electroplating rack on which the clamp is operatively installed.
Figure 2:
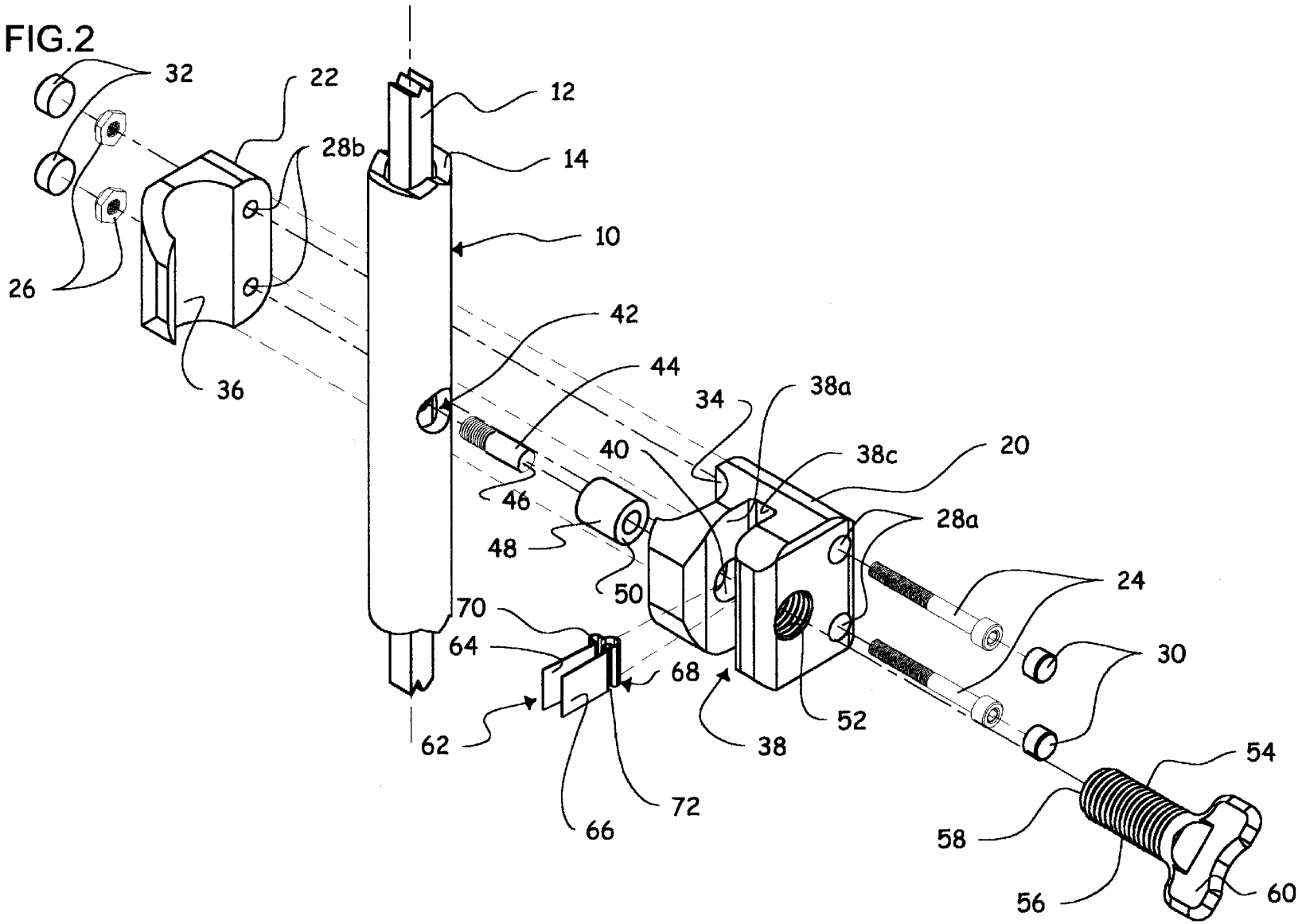

FIGS. 1 to 4 show a portion of an electroplating rack in the form of a vertical bar 10 which is attached to a cathode flight bar (not shown). Bar 10 is formed of an inner electrically conducting core rod 12, e.g. made of copper and having a square cross-section (although any suitable shape is acceptable), which is electrically connected to the cathode flight bar, and of an outer electrically insulating and fluid-tight sheath 14, e.g. made of plastic and having an annular cross-section (although any suitable closed shape is acceptable).

A clamp 16 according to the invention is attached to bar 10 as described hereinafter, for holding an article such as a board to be electroplated, to form an integrated circuit board. Clamp 16 comprises a main body or frame 18 formed of a first and a second block 20, 22 attached to each other by bolts 24 and nuts 26 running through channels 28*a*, 28*b* formed coextensively through first and second blocks 20, 22, respectively. Caps 30, 32 sealingly block channels 28*a*, 28*b*, respectively. Blocks 20, 22 and caps 30, 32 are made of an electrically insulating and fluid-tight material, such as a suitable plastic material.

First and second blocks 20, 22 have semi-cylindrical inner surface portions 34, 36 respectively (see FIG. 2), which are in facing register with each other, and which together form a channel through which bar 10 coaxially extends.

First block 20 is generally U-shaped and defines a cavity or slot 38 which has an inner wall 38*a*, an outer wall 38*b* and an end wall 38*c*. A first through-bore 40 in first block 20 extends from the cavity inner wall 38*a* to cylindrical surface 34, and is positioned coaxially with an opening 42 in the bar outer sheath 14. A short conducting bridge member 44, e.g. made of copper and formed from a cylindrical rod (although any suitable shape is also acceptable), threadingly engages conducting rod 12 so as to be electrically connected thereto, and extends through opening 42 and through-bore 40. Conducting bridge member 44 has an outer free tip 46 which protrudes at least slightly beyond the first block cavity inner surface 38*a*. A flexible insulating sleeve 48 is provided around conducting bridge member 44 except at its attachment to rod 12, with the outer free end portion 50 of sleeve 48 protruding at least slightly beyond the conducting bridge outer free tip 46. Insulating sleeve can be made of rubber, although any other flexible, electrically insulating and fluid-tight material is acceptable.

A second threaded through-bore 52 in first block 20 extends outwardly from the cavity outer wall 38*b*, and is coaxial with first through-bore 40. Clamp 16 also includes a screw 54 comprising a threaded shaft 56 which is threadingly engageable into second through-bore 52, a flat free tip 58 and a manually operable head portion 60.

Figure 3:
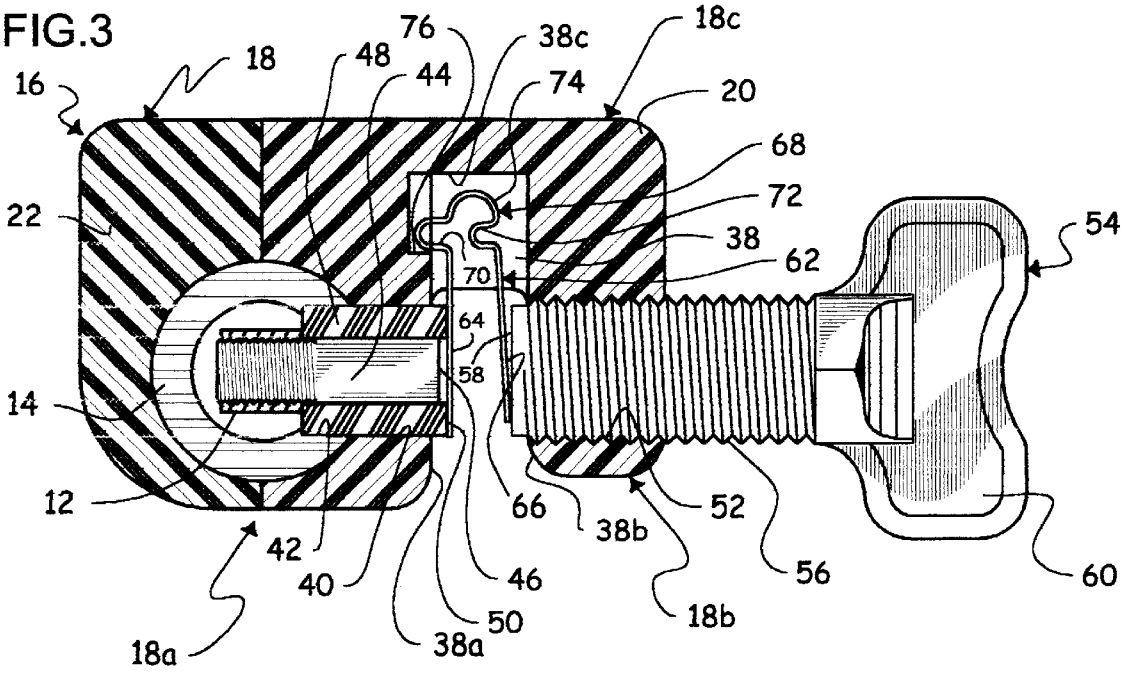
FIGS. 3 and 4 are top plan cross-sectional views of the clamp of FIGS. 1 and 2, respectively showing at an enlarged scale the clamp in an opened condition and in a closed condition with a board being held.
Figure 4:
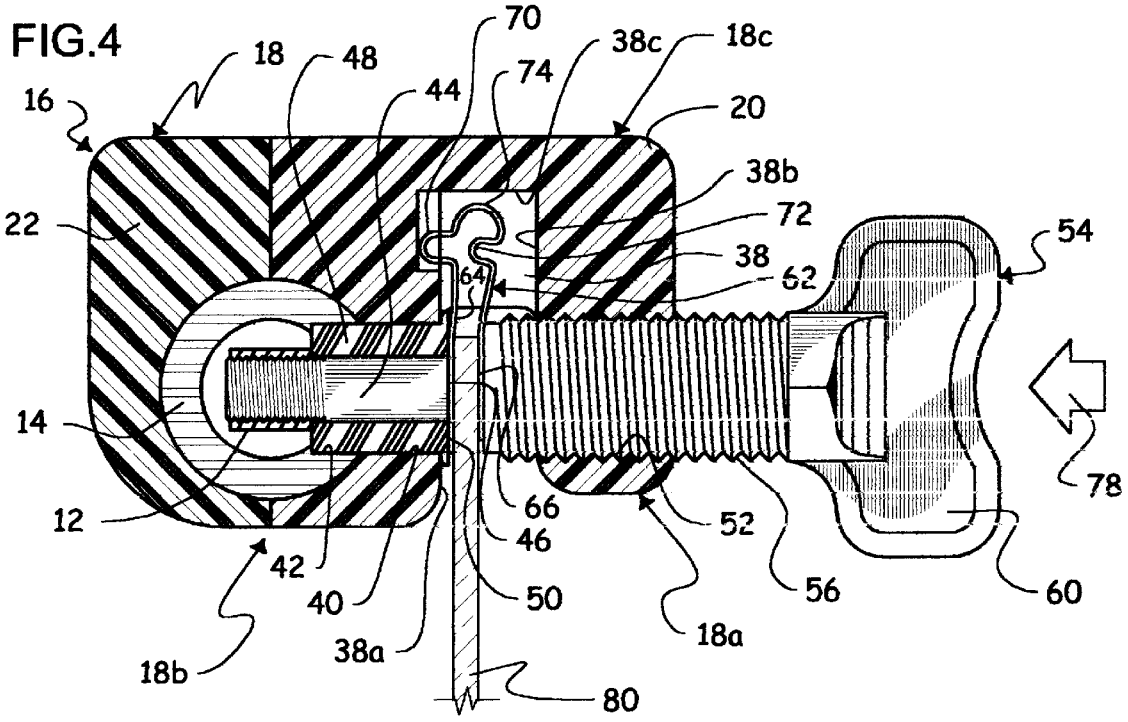

A spring clip 62 formed from a rectangular flat metallic sheet folded in two to comprise a pair of flat arms 64, 66 in spaced facing register with each other, and an arcuate foot or web portion 68 linking arms 64 and 66 and having a pair of lips 70, 72 and an elbow 74. As seen in FIGS. 3 and 4, generally U-shape spring clip 62 is installed in cavity 38, and more particularly with foot portion 68 being closely adjacent to or abutting against the cavity end wall 38*c*, with the spring clip first arm 64 extending substantially parallel and adjacent to the cavity inner wall 38*a*, and with the spring clip second arm 66 extending substantially parallel and adjacent to the cavity outer wall 38*b*. Outwardly protruding lip 70 helps prevent accidental release of spring clip 62 out of cavity 38 by its abutment against a shoulder 76 (FIG. 3) formed in inner wall 38*a*, and eventually also against the protruding portion of seal 48 which will also act as a retaining shoulder for clip 62. Spring clip 62 is continuously biased under its own intrinsic resiliency towards an opened condition, in which first arm 64 is forced against the protruding portion 50 of seal 48, while second arm 66 is forced against the screw tip 58, or alternately against the first block cavity outer surface 38*a* if the screw tip 58 is concealed in second through-bore 52 and does not protrude therefrom into cavity 38. In any event, a gap is defined between first and second arms 64, 66. Spring clip 62 can be made of stainless steel, copper or beryllium copper, or any other suitable electrically conducting material.

Clamp 16 is installed on rack bar 10 by assembling blocks 20, 22 around bar 10 as shown in FIGS. 1, 3 and 4. First through bore 40 is aligned with the sheath opening 42, and conducting bridge member 44 is threadingly engaged into conducting core 12, through first through-bore 40 and sheath opening 42, together with insulating sleeve 48. Spring clip 62 is then simply forced against its own resiliency axially into cavity 38 with web 68 as the leading edge, and screw 54 is installed in its threaded passage 52. It is noted that the coaxial through-bores 52 and 40 allow installation of bridge member 44 and insulating sleeve 48 through second through bore 52.

Once thus installed on rack bar 10, clamp 16 defines a main body 18 which has a first lateral body portion 18*a* located on one side of slot 38, a second lateral body portion 18*b* located on a second side of slot 38, and a web 18*c* integrally linking the first and second lateral body portions 18*a,* 18*b*.

Also, it is noted that the combination of the bolt and nut assembly 24, 26, together with the threaded engagement of bridge member 44 into the rack bar conductive core 12, form an attachment member for attaching clamp 16 onto rack bar 10.

In use, a board 80 to be electroplated may be removably installed on clamp 16. To this end, the side edge portion of board 80 is inserted and held in the gap between the two arms 64, 66 of spring clip 62 while screw 54 is rotated in a first direction by manually operating its head portion 60, screw 54 then moving towards board 80 as suggested by arrow 78 in FIG. 4. This translational displacement of screw 54 will force spring clip second arm 66 towards board 80 under a yielding deformation of the spring clip foot portion 68, due to the screw flat tip 58 abutting against the spring clip second arm 66. This will force spring clip 62 into a closed condition, in which arm 66 will abut against board 80 and become squeezed between the flat screw tip 58 and board 80. By forcibly tightening screw 54, board 80 will then be securely held and carried by clamp 16 by its squeezed engagement between the two arms 64, 66 of spring clip 62.

The tightening of screw 54 also has the effect of squeezing and yieldingly deforming the protruding end portion 50 of insulating sleeve 48, between the clip first arm 64 and the first block cavity inner wall 38*a*. As shown in FIG. 4, this will result in physical contact occurring between the spring clip first arm 64 and the otherwise axially concealed conducting bridge member outer free tip 46. The squeezed end portion 50 of insulating sleeve 48 will then act as an electrically insulating and fluid-tight seal for conducting bridge member about the contact area between the bridge tip 46 and spring clip first arm 64.

The rack of which rack bar 10 is a part of, can then be lowered into the acid bath where the electroplating will occur. Indeed, the cathode flight bar (not shown) is electrically connected to the conducting bar core 12, which in turn is electrically connected to the conducting bridge member 44, which is in turn electrically connected to the spring clip 62, which is in turn electrically connected to board 80. Thus, electrical current will be allowed to flow through the above-named elements, and in particular through board 80, so as to accomplish electroplating thereof, as known in the art, while the board 80 is submerged in the acid bath.

One particular advantage of clamp 16 resides in the use of conductive spring clip 62. Indeed, spring clip 62 offers the following advantages to the electroplating clamp:

a) Simple electrical connection is obtained between the clamp conducting bridge member 44 and board 80, on both sides of board 80, due to the spring clip engaging board 80 on both sides thereof. This is especially desirable when dealing with thicker boards which will often include multiple layers, offering a non-negligible resistance to the electrical current thicknesswisely through the board. The engagement of spring clip 62 on both sides of board 80 thus prevents the electrical current to have to cross the whole board thickness to reach the farther layers. This is a simpler solution than providing two conducting bridge members as in the above-mentioned Wismer patent, in which the two distinct conducting bridge members respectively provided in the screw core and in the stopper member core require a more complex clamp configuration, since they each have to be connected to the rack conducting element, they each have to be insulated and they each have to be provided with seals that will engage the board surfaces.

b) Since the screw tip 58 does not engage the board directly, no damage to the board will occur under the rotational shearing friction between the screw tip and the board surface, as with the Wismer device. This is especially advantageous with ultra-thin boards, which are more fragile and become more easily damaged. Indeed, the screw tip 58 only engages the outer surface of the spring clip second arm 66, which in turn flatly and transversely presses smoothly against the board surface, without shearing action thereon.

c) Due to the conductivity of spring clip 62, and as with most conducting elements which link the board to be electroplated to the rack, spring clip 62 will inevitably and gradually accumulate plating thereon during use, and will eventually have to be replaced. Due to the simplicity of the shape and of the configuration of spring clip 62 which is simply a bent sheet of metal, it can be produced at low cost, and replacement clips can be obtained inexpensively. Also, the simple engagement of spring clip 62 into the clamp cavity 38 allows easy removal and installation of spring clip 62, simply by forcing it out of or into cavity 38 against its own resiliency. Thus, it is neither expensive nor time consuming to replace spring clip 62. Additionally, it is envisioned to provide spring clips made of different materials, according to particular needs. For example, stainless steel spring clips will have a longer life span since they do not become corroded rapidly, but will offer a poorer electrical conductivity. On the other hand, copper-based spring clips will have a shorter life span, but will offer far greater electrical conductivity characteristics. It is possible to easily change from one type of spring clip to the other, at a relatively low cost, since the remaining portion of clamp 16 remains unchanged.

d) The particular shape of foot web portion 68, including a pair of lips 70, 72 in addition to the elbow 74, has shown unexpected and particularly advantageous results in allowing spring clip 62 to recover its shape even after repeated forced deformation of spring clip 62 under screw 54 forcing clip 62 into its closed condition against board 80. Indeed, the two lips 70, 72, with the second lip 72 being inwardly oriented towards the first lip 70, and with the first lip 70 protruding outwardly relative to the spring clip main body, help prevent permanent plastic deformation of the elbowed portion 74 of spring clip 62. In addition to this very important non-plastic deformation characteristic, the outwardly protruding first lip 70 further helps prevent the clip 62 from accidental release out of the first block cavity 38, as noted hereinabove, due to its abutment against the shoulder 76 formed in the cavity inner wall 38*a*.

It is noted that a single rack will usually include a number of rack bars 10, each provided with one or more clamps 16, thus allowing multiple boards 80 to be electroplated at the same time when the rack bars 10 are being submerged. It is farther envisioned to provide clamps which can hold more than a single board.

Figure 5:
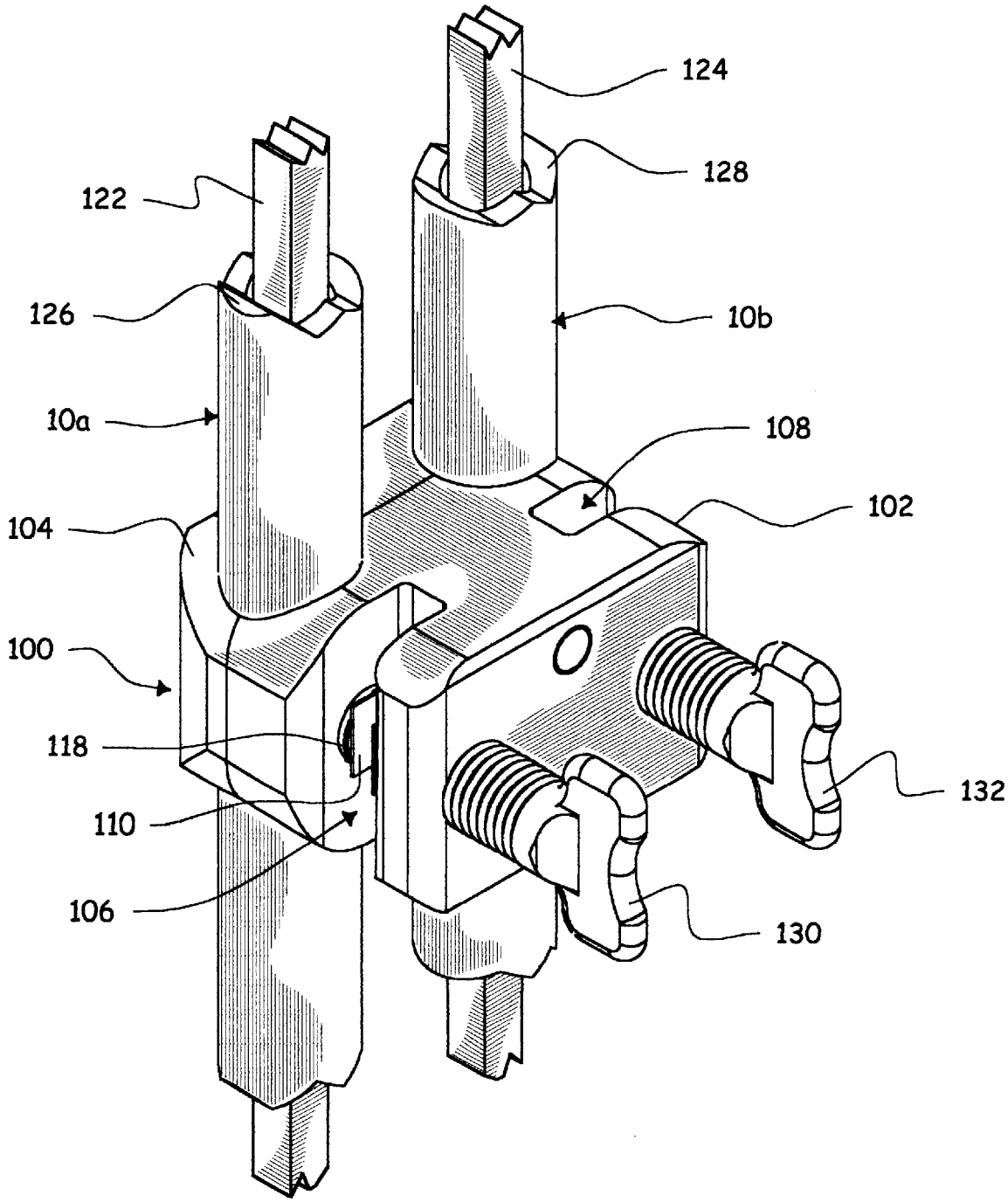
FIGS. 5 and 6 are respectively a perspective view and an exploded perspective view of a second embodiment of the clamp according to the present invention, and further showing a portion of an electroplating rack on which the clamp is operatively installed.
Figure 6:
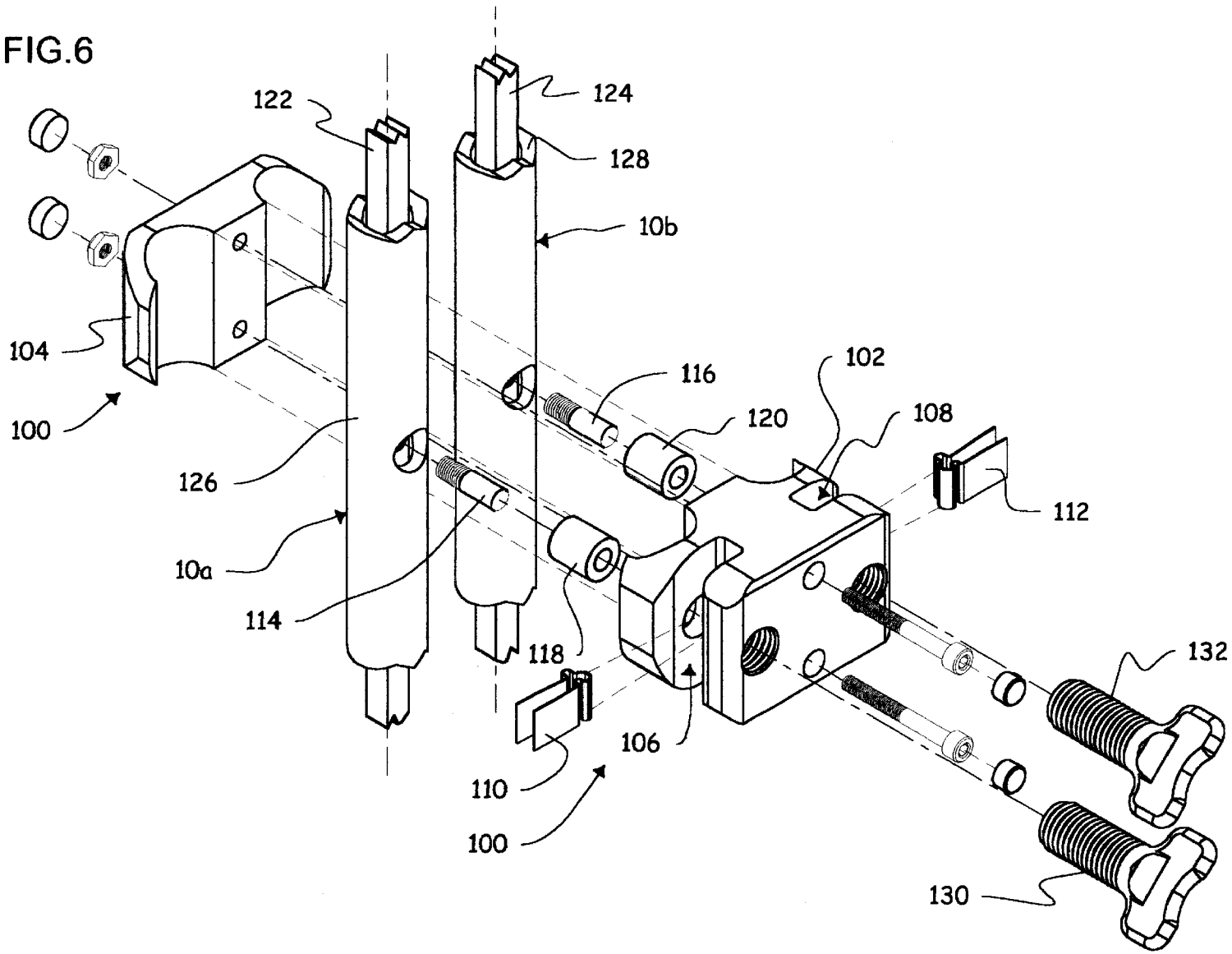

For example, FIGS. 5 and 6 show a clamp 100 destined to hold two boards (not shown). Clamp 100, apart for the fact that it is sized and shaped to hold two boards, is similar to clamp 16 of FIGS. 1–4. Clamp 100 includes a first and a second block 102, 104 attached to each other about first and second rack bars 10*a*, 10*b*. First block 102 includes a pair of laterally opposite cavities or slots 106, 108 each destined to receive a respective board therein. Identical spring clips 110, 112 are provided in each slot 106, 108. Conducting bridge members 114, 116, provided with their respective insulating sleeves 118, 120, electrically link the conducting cores 122, 124 of bars 10*a*, 10*b* to spring clips 110, 112 through the bar insulating sheaths 126, 128. Screws 130, 132 are used to bias spring clips 110, 112 into a closed condition, for forcibly taking in sandwich therebetween the boards to be electroplated.

It is understood that although the two embodiments of clamps 16, 100 have been described to hold the boards by their side edge portions, they could hold the boards by any other edge portion, as long as they are accordingly disposed on the electroplating rack. Also, especially for larger boards, it is possible to have a board be supported by two or more clamps, which will then more stably hold the board in addition to providing a more efficient electrical current distribution in the board.

It is noted that although a screw has been shown and described to bias the spring clip 62 from an opened condition in which the two arms 64, 66 are spaced-apart and define a gap therebetween, to a closed condition in which the two arms 64, 66 are pivoted towards each other, any other suitable selectively operable pressure member capable of moving the spring clip arms into their closed condition would also be acceptable.

Any other modification to the present invention, which does not deviated from the scope thereof, is included in the scope thereof

I claim:

1. A spring clip for use as a connection member on an electroplating clamp, said spring clip being integrally formed of a folded, generally flat electrically conducting material and comprising a first and a second arm member and an arcuate foot member integrally linking said first and second arm members, said foot member having:

a resilient elbow portion, allowing relative pivotal displacement of said first and second arm members between an opened condition, in which said first and second arm members spacedly register with one another and define a gap therebetween, and a closed condition, in which said first and second arm members are pivoted towards each other to at least reduce said gap therebetween, with said resilient elbow portion continuously biasing said first and second arm members towards said opened condition;

a first resilient lip, integrally formed between said elbow and said first arm member, said first lip protruding outwardly relative to said gap; and a second resilient lip, integrally formed between said elbow and said second arm member, said second lip protruding inwardly toward said gap and toward said first lip.

2. A clamp for use on an electroplating rack of the type having an electrically conducting flight bar, said clamp comprising:

a main body made of an electrically insulating material;

an attachment member, for fixed attachment of said main body to the rack;

a conducting bridge member carried by said main body for electrical connection with the flight bar of said rack;

a spring clip carried by said main body and able to come into electrical contact with said bridge member, said spring clip being made of an electrically conducting material and being provided with first and second arms and an arcuate pivotable foot member linking said first and second arms, said pivotable foot member allowing relative pivotal displacement of said first and second arms between an opened condition in which said first and second arms spacedly register with one another so as to define a gap therebetween, and a closed condition, in which said first and second arms are pivoted towards each other to at least reduce said gap therebetween and in which said spring clip is in electrical contact with said bridge member;

a selectively operable pressure member carried by said main body and engageable with said spring clip so as to selectively pivot said first and second arms relative to each other from said opened condition towards said closed condition; and a biasing member continuously biasing said first and second arm members toward said opened condition.

3. A clamp as defined in claim 2, wherein said foot member of said spring clip is resilient and integrally links said first and second arms, said biasing member being said resilient foot member and continuously biasing said first and second arms towards said opened condition.

4. A clamp as defined in claim 3, wherein said spring clip is integrally formed of a folded, generally flat electrically conducting sheet, and wherein said foot member integrally linking said first and second arms comprises:

a resilient elbow portion allowing relative pivotal displacement of said first and second arms between said opened condition and said closed condition, with said resilient elbow portion continuously biasing said first and second arms towards said opened condition;

a first resilient lip, integrally formed between said elbow and said first arm, said first lip protruding outwardly relative to said gap; and a second resilient lip, integrally formed between said elbow and said second arm, said second lip protruding inwardly toward said gap and toward said first lip.

5. A clamp as defined in claim 4, wherein said pressure member is a screw threadingly engaging said clamp main body through a through-bore provided therein, said screw being able to gradually apply pressure on said spring clip second arm when said screw is rotated in a first direction to pivot said second arm towards said first arm and consequently pivot said first and second arms towards said closed condition, and said screw being able to gradually relieve the pressure on said spring clip second arm when said screw is rotated in a second direction opposite said first direction to allow said resilient foot member to bias said second arm away from said first arm and consequently pivot said first and second arms towards said opened condition.

6. A clamp as defined in claim 5, wherein said bridge member defines a tip portion engageable with said spring clip at least when said first and second arms are in said closed condition, said clamp further comprising an insulating sleeve provided about said bridge member tip portion for sealing engagement against said spring clip about said bridge member tip portion at least when said first and second arms are in said closed condition.

7. A clamp as defined in claim 6, wherein said main body is generally U-shaped and defines a slot and a first lateral body portion for attachment to the rack, a second lateral body portion opposite said first body portion relative to said slot, and a web portion integrally linking said first and second lateral body portions, said spring clip being installed in said slot and being retained therein under said first and second arms being forced respectively against said first and second lateral body portions under the bias of said foot member, and said screw threadingly engaging a threaded through-bore made through said second lateral body portion, said screw having a tip portion engageable against said spring clip second arm.

8. A clamp as defined in claim 7, wherein said main body comprises a shoulder integrally formed in said slot, said spring clip first lip being capable of abutting against said shoulder to prevent accidental release of said spring clip from said slot.

9. A clamp as defined in claim 8, wherein said main body comprises a first block member and a second block member for attachment to on two opposide sides of the rack with said attachment member.

10. An electroplating rack for electroplating an article in an acid bath, said rack comprising a cathode flight bar and a rack bar downwardly depending from said flight bar, said rack bar including an electrically conducting core electrically connected to said cathode flight bar and a fluid-tight, electrically insulating sheath enveloping said conducting core, said electroplating rack further comprising a clamp fixedly attached to said rack bar, said clamp comprising:

a main body made of an electrically insulating material;

an attachment member fixedly attaching said main body to said rack bar;

a conducting bridge member defining a core connection portion and a free tip portion, said bridge member being carried by said main body and being electrically connected with said rack bar conducting core at said core connection portion;

an electrically insulating and fluid-tight sleeve provided about said conducting bridge member and enveloping same except at said core connection portion and at said free tip portion, said sleeve comprising a seal portion near said bridge member free tip portion;

a spring clip carried by said main body and able to come into electrical contact with said bridge member free tip portion, said spring clip being made of an electrically conducting material and being provided with first and second arms and a pivotable foot member integrally linking said first and second arms, said pivotable foot member allowing relative pivotal displacement of said first and second arms between an opened condition in which said first and second arms are in spaced-apart register so as to define a gap therebetween, and a closed condition in which said first and second arms are pivoted towards each other to at least reduce said gap therebetween and in which said spring clip first arm is in electrical contact with said bridge member free tip portion, said seal portion of said sleeve engaging said spring clip about said bridge member free tip portion at least when said spring clip is in said closed condition so as to form a fluid-tight seal for said bride member free tip portion;

a biasing member continuously biasing said spring clip first and second arms towards said opened condition; and a selectively operable pressure member carried by said main body and engageable with said spring clip so as to selectively pivot said first and second arms relative to each other from said opened condition towards said closed condition against the bias of said biasing member; wherein an article to be electroplated can be inserted into said gap between said first and second arms when said first and second arms are in said opened condition, said pressure member then being selectively operated to force said first and second arms into said closed condition for holding the article between said first and second arms, an electrical connection then existing sequentially through said flight bar, said conducting core, said bridge member, said spring clip and finally the article to be electroplated.

11. An electroplating rack as defined in claim 10, wherein said foot member of said spring clip is resilient and integrally links said first and second arms, said biasing member being said resilient foot member.

12. An electroplating rack as defined in claim 11, wherein said spring clip is integrally formed of a folded, generally flat electrically conducting sheet, and wherein said foot member integrally linking said first and second arms comprises:

a resilient elbow portion allowing relative pivotal displacement of said first and second arms between said opened condition and said closed condition, with said resilient elbow portion continuously biasing said first and second arms towards said opened condition;

a first resilient lip formed between said elbow and said first arm, said first lip protruding outwardly relative to said gap;

a second resilient lip formed between said elbow and said second arm, said second lip protruding inwardly toward said gap and toward said first lip.

13. An electroplating rack as defined in claim 12, wherein said pressure member is a screw threadingly engaging said clamp main body through a through-bore provided therein, said screw being able to gradually apply pressure on said spring clip second arm when it is rotated in a first direction to pivot said second arm towards said first arm and consequently pivot said first and second arms towards said closed condition, and said screw being able to gradually relieve the pressure on said spring clip second arm when it is rotated in a second direction opposite said first direction to allow said resilient foot member to bias said second arm away from said first arm and consequently pivot said first and second arms towards said opened condition.

14. An electroplating rack as defined in claim 13, wherein said main body is generally U-shaped and defines a slot and a first lateral body portion fixedly attached to said rack bar, a second lateral body portion opposite said first body portion relative to said slot, and a web portion integrally linking said first and second lateral body portions, said spring clip being installed in said slot and being retained therein under said first and second arms being forced respectively against said first and second lateral body portions under the bias of said foot member, and said through bore being made through said second lateral body portion.

15. An electroplating rack as defined in claim 14, wherein said main body comprises a shoulder integrally formed in said slot, said spring clip first lip being capable of abutting against said shoulder to prevent accidental release of said spring clip from said slot.

16. An electroplating rack as defined in claim 15, wherein said main body comprises a first block member and a second block member each engaging said rack bar on opposite sides thereof, and being attached to each other with said attachment member.

17. An electroplating rack as defined in claim 14, wherein said clamp comprises an additional slot formed in said main body, with an additional spring clip being provided therein, and with an additional screw being engageable with said additional spring clip for releasably holding an additional article when said additional spring clip is in a closed condition, said clamp further comprising an additional bridge member electrically connected to said additional spring clip when said additional spring clip is in said closed condition, said rack comprising an additional rack bar having an additional conducting core enveloped in an additional insulating sheath, with said additional bridge member being electrically connected to said additional conducting core, said additional clamp being fixedly attached also to said additional rack bar with said attachment member, whereby the additional article can be carried by said clamp simultaneously with the first-named article.

* * * * *